United States Patent [19]

Main, Jr.

[11] 4,236,941

[45] Dec. 2, 1980

[54] METHOD OF PRODUCING HEAT TREATMENT ATMOSPHERE

[75] Inventor: Ray F. Main, Jr., Birmingham, Mich.

[73] Assignee: General Motors Corporation, Detroit, Mich.

[21] Appl. No.: 5,240

[22] Filed: Jan. 22, 1979

Related U.S. Application Data

[63] Continuation of Ser. No. 836,580, Sep. 26, 1977, abandoned.

[51] Int. Cl.[3] ..... C21D 1/34

[52] U.S. Cl. ..... 148/16.5; 48/197 R; 252/373

[58] Field of Search ..... 48/197 R, 212, 213, 48/215, 197 FM; 148/16.5; 252/373, 372; 75/34, 35, 91

[56] References Cited

U.S. PATENT DOCUMENTS

| | | | |
|---|---|---|---|
| 2,089,545 | 8/1937 | Dow | 148/16.5 |
| 2,329,896 | 9/1943 | Harsch | 148/16.5 |
| 2,334,652 | 11/1943 | Schmitt | 148/16.5 |
| 3,042,507 | 7/1962 | Hilgers | 48/215 |
| 3,290,030 | 12/1966 | Goehring | 266/5 |
| 3,320,093 | 5/1967 | Harding et al. | 136/122 |
| 3,413,161 | 11/1968 | Goehring | 148/16.5 |
| 3,846,095 | 11/1974 | Crouch | 48/212 |
| 4,060,397 | 11/1977 | Buiter et al. | 48/210 |
| 4,081,253 | 3/1978 | Marion | 48/215 |
| 4,099,383 | 7/1978 | Paull et al. | 252/373 |

OTHER PUBLICATIONS

American Society for Metals, Metals Handbook, vol. 2, pp. 75–78 (8 Ed. 1964).

*Primary Examiner*—Raymond N. Jones
*Assistant Examiner*—George C. Yeung
*Attorney, Agent, or Firm*—Douglas D. Fekete

[57] ABSTRACT

An endothermic-base type heat treating furnace atmosphere is produced in an external generator by a partial oxidation between air and alcohol (e.g. ethanol). An alcohol-rich mixture is prepared and reacted at an elevated temperature to form a product gas comprising carbon monoxide, nitrogen, hydrogen, carbon dioxide, methane and water. The product gas is quickly cooled and any water that condenses is removed. The generator product gas is then introduced into a furnace within which it usually undergoes further reaction to provide a suitable nonoxidizing heat treating atmosphere. In one aspect of this invention, the generator gas is used for carburizing ferrous metal workpieces without additional increase of the carbon potential.

4 Claims, 2 Drawing Figures

METHOD OF PRODUCING HEAT TREATMENT ATMOSPHERE

This is a continuation of application Ser. No. 836,580, filed Sept. 26, 1977, now abandoned.

This invention relates to a process for producing a nonoxidizing atmosphere for use in industrial furnaces during the heat treatment of metal. More particularly, this invention relates to a method for producing an endothermic-base type furnace atmosphere by a partial oxidation reaction between air and an alcohol. In one aspect of this invention, a highly reactive gas carburizing atmosphere is produced.

The heat treatment of metal within a furnace in order to enhance various properties of the metal is well established. Because oxygen, carbon dioxide and water tend to oxidize or decarburize hot metal surfaces, it is essential to many heat treatment processes that the metal be protected from contact with air. This is typically accomplished by substituting a protective atmosphere for air within the furnace. Thus, modern heat treatment processes require large volumes of suitable gases for maintaining protective furnace atmospheres.

One prior art method of supplying suitable furnace atmospheres is by using an endothermic-base generator. Endothermic generators react fuel-rich mixtures of air and a hydrocarbon gas such as methane at elevated temperatures to produce atmospheres containing large concentrations of hydrogen, carbon monoxide and nitrogen, but trace amounts of oxygen, carbon dioxide and water. An essential feature of endothermic generators is that the air-hydrocarbon gas mixture is heated by an external source to a temperature of about 1800° F. in order to promote reactions that produce the desired product gas. Although the overall reaction between the air and the hydrocarbon fuel may not truly be endothermic, the term endothermic is conveniently used to characterize such atmospheres because it distinguishes them from prior art exothermic atmospheres and because it calls attention to the fact that the desired reaction products are obtained with an external source of heat.

The product gas from such an endothermic generator can be introduced directly into the furnace to provide a suitable protective atmosphere therein. However, the composition of the gas is such that it has only a neutral or nonoxidizing or nondecarburizing effect on a metal workpiece. The prior art endothermic-base gas is not usually suitable as is for active treatments such as carburizing or carbonitriding. For this type of processing, active constituents are added to the generator gas in order to enhance its ability to treat the metal in the desired fashion. For example, ferrous metal is carburized by the addition of reactive carbon-containing compounds in the endothermic-base furnace atmosphere. The carbon potential of the endothermic generator gas for carburizing is increased either by bleeding a gaseous organic compound into the generator gas before it is introduced into the furnace or by dripping an organic liquid directly into the furnace. This requires careful control of both the composition of the generator gas and the flow of the carbon source into the furnace.

Prior art endothermic atmospheres were generally produced using methane or natural gas. Recent natural gas shortages have caused heat treating facilities relying on such atmospheres to shut down. Natural gas and other hydrocarbon gases were preferred, in part, because they consisted solely of carbon and hydrogen. It was not believed practical to employ an oxygen-containing organic fuel to produce an endothermic-base atmosphere because the additional oxygen would necessarily result in more carbon dioxide and water in the generator product gas.

It is an object of this invention to provide a method of generating a useful heat treating atmosphere using a readily available substitute for scarce or potentially scarce hydrocarbon gas. It is a further object of this invention to provide a method of producing a heat treating atmosphere by a reaction between air and a liquid alcohol fuel that may be easily shipped and stored at a facility until needed. More specifically, it is an object of this invention to provide an endothermic-base type heat treating atmosphere by a partial oxidation reaction between air and a suitable alcohol.

It is also an object of the present invention to provide a method and apparatus for producing an endothermic-base type atmosphere for heat treating furnaces by modifying conventional natural gas operated endothermic generator equipment to be operated using liquid alcohol fuel.

It is also an object of this invention to provide a method of producing a carburizing atmosphere by a partial oxidation reaction of air and alcohol at an elevated temperature, the product gas being useful for carburizing without the addition of further carbon-containing material.

BRIEF SUMMARY OF THE INVENTION

In accordance with a preferred embodiment, these and other objects are accomplished by carrying out a partial oxidation reaction between air and a chemical equivalent excess of a relatively low molecular weight alcohol. Suitable alcohols include methanol, ethanol, propanol, butanol or mixtures thereof; ethanol being preferred. Heat is supplied to raise the reaction temperature to above 1300° F. and preferably between 1400° F. and 1850° F. At the elevated temperature, the reaction of the alcohol-rich mixture consumes virtually all of the free oxygen and favors the formation of an initial product gas which is substantially soot-free and is composed predominately of hydrogen, carbon monoxide and unreacted nitrogen. The reaction also produces significant quantities of hydrocarbons, such as methane and ethylene, and also of carbon dioxide and water. The later species are known to be detrimental to normal heat treatment operations. Much of the water is physically removed before the product gas is introduced into a heat treating furnace.

Within the hot heat treating furnace, the gas usually undergoes further reactions that significantly alter its composition. Carbon dioxide and residual water react with some of the methane and other hydrocarbons formed during the initial air-alcohol reaction to produce additional carbon monoxide and hydrogen. The concentration of the carbon dioxide and water are thus lowered to acceptable levels and the resulting furnace atmosphere is rendered suitable for normal heat treating operations.

The resulting alcohol derived gas is useful to provide suitable nonoxidizing furnace atmospheres for a wide variety of metal heat treatment operations. The atmosphere produced by this invention is predominately composed of nitrogen, hydrogen and carbon monoxide, constitutents known to be conducive to normal heat treating operations and present (in different proportions) in prior art endothermic-base atmospheres produced from natural gas or the like. The subject gas also contains significant quantities of hydrocarbons such as methane and ethylene that are produced during the partial oxidation reaction between air and alcohol and are not completely consumed within the furnace in the reactions that reduce the concentration of carbon dioxide and water. These residual hydrocarbons provide an active carbon source within the furnace usually rendering it unnecessary to add additional organic material for carburizing. The hydrocarbon concentration and thus the carbon potential of the heat treating atmosphere can be controlled as desired for a particular heat treating operation by adjusting reaction parameters.

An important parameter in controlling the composition of the alcohol derived gas is the weight ratio of air to alcohol in the reactant mixture. The quantity of alcohol reacted with the air must be greater than that amount necessary for complete stoichiometric combustion to produce carbon dioxide and water. In addition, the proportions of alcohol and air are preferably such as to form greater portions of carbon monoxide and hydrogen and relatively small portions of carbon dioxide and water. Also, it is essential to the practice of this invention that the alcohol react with substantially all the free oxygen in the air. In a preferred embodiment, the air-alcohol reactions take place in a very short period of time and do not reach equilibrium. A suitable chemical equivalent excess of alcohol should be employed to assure that substantially all free oxygen is consumed before the initial product gas is introduced into the heat treating furnace. In a preferred embodiment using ethanol to produce a heat treating atmosphere, weight ratios of air to ethanol of between 1.0 and 3.0 were found to produce suitable furnace atmospheres.

In the reaction, some of the excess alcohol typically forms hydrocarbons such as methane and ethylene. As described above, some of hydrocarbon is consumed in reactions that occur after the partially dried product gas is introduced into the heat treating furnace and the remainder may serve as carburizing agents. It has been found that the concentration of hydrocarbons in the furnace atmosphere is directly related to the proportion of air to alcohol in the reactant mixture. Therefore, where the air-alcohol ratio is adjusted so that little or no hydrocarbons remain after the partially dried product gas has reached equilibrium within the furnace, the resulting atmosphere is neither oxidizing nor carburizing and is suitable for heat treating processes such as annealing or bright hardening. Increasing the proportion of alcohol produces more hydrocarbons and thus a more active carburizing atmosphere. The carbon potential of the resulting furnace atmosphere can be controlled by adjustment of the hydrocarbon concentration in the furnace atmosphere. In a preferred embodiment, air to ethanol weight ratios of about 3 produced a suitable neutral heat treating atmosphere while ratios of less than about 2 produced carburizing atmospheres. It has been found that the atmosphere produced by this invention is more efficient in carburizing than prior art natural gas endothermic-base atmospheres having the same hydrocarbon concentration.

In a preferred embodiment, the air-ethanol partial oxidation reaction is conducted in a generator separate from the heat treating furnace. The generator comprises a reaction chamber containing a packed bed of suitable heat resistant particles, such as alumina or alumina-silica 1 inch O.D. rings, providing a relatively large surface conducive to the reaction. Suitable heating means are provided to maintain the desired elevated temperature within the reaction space. The reaction chamber may be of any suitable construction and, for example, a conventional endothermic-type atmosphere generator now operating using natural gas may be adapted by this invention to operate using alcohol. Preferably, liquid ethanol is pumped directly into the heated reaction bed. The ethanol vaporizes and mixes with air entering the chamber through a separate inlet. The resulting ethanol-air mixture reacts quickly to consume all the free oxygen and produce the desired initial reaction product gas. The product gas is then quickly cooled in one or more steps to a temperature below 100° F. and preferably below 40° F. Any water that condenses during cooling is removed so that the dew point of the initial product gas is reduced to the temperature of the gas. The cooled product gas may then be introduced into a heat treating furnace.

This invention enables a substantially soot-free generator gas to be produced from a high-temperature partial oxidation reaction with liquid alcohol. The reaction conditions can be adjusted to provide a wide variety of heat treating atmospheres. In addition, the composition of the gas can obviously be altered further by mixing it with additional or new constituents such as ammonia or methane. As a result, the furnace atmosphere produced by this invention can be easily tailored to meet the specific needs of a particular heat treating operation.

BRIEF DESCRIPTION OF THE DRAWINGS

The present invention will be further illustrated with reference to the accompanying drawings wherein.

DETAILED DESCRIPTION OF THE PREFERRED EMBODIMENT

Figure 1:
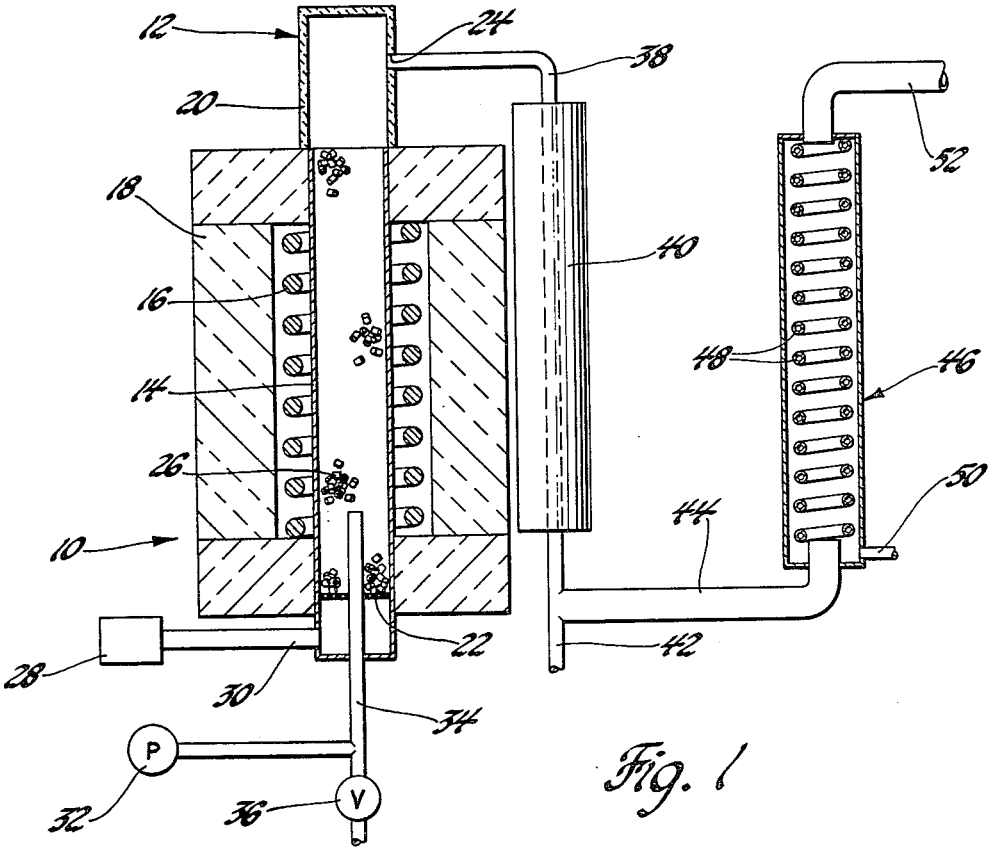
FIG. 1 is a sectional view of an endothermic-base type generator of this invention.

Referring now to FIG. 1, a gas generator 10 is illustrated for producing a furnace atmosphere by this invention. In this preferred embodiment, air and denatured ethanol are reacted in a continuous process that produces a furnace atmosphere suitable for gas carburizing iron workpieces. The ethanol composition contained as denaturants 1 gallon of ethyl acetate, 1 gallon of methyl isobutyl ketone and 1 gallon of gasoline for every 100 gallons of specially denatured alcohol formula No. 1 (5 gallons of methanol for each 100 gallons of 190 proof ethanol), according to Government Proprietary Solvent Formulation III. It is apparent that other ethanol formulations containing other denaturants or water could be substituted in the practice of this invention with little or no effect on the resulting atmosphere composition.

The initial air-ethanol reactions occur within a vertically oriented, cylindrical retort 12. In a specific example, retort 12 comprises a metallic tube 14, 6 feet, 4 inches long and having an inner diameter of about 9 inches. Encircling tube 14 are electrical heating elements 16 contained within a suitable insulator body 18. Extending 25 inches above the top of tube 14 is a refractory cap 20. Ambient air enters retort 12 through a perforated metallic plate 22 in the bottom of tube 14. An opening 24 in the side of cap 20 provides an outlet for the hot reacted gas. Retort 12 must be constructed airtight especially because of the explosive nature of the hot gases produced in this process. In this embodiment, a retort commercially available from the Surface Combustion Division of the Midland-Ross Corporation as RX Generator, Model T-1-E, may be adapted to react alcohol-air mixtures by this invention.

A bed of particles 26 is formed within tube 14 above plate 22 to provide a surface conducive to the partial oxidation reaction. Particles 26 consist of 85% alumina $Al_2O_3$ and 15% silica $SiO_2$ and are shaped as rings having a 1 inch outer diameter, ½ inch inner diameter and a length of about 1 inch (commercially available from the Norton Company under the trade name Norton Catalyst Carriers SA-5504). About 100 pounds of particles were required to provide a suitable reaction bed in this embodiment.

Air compressor 28 connected to tube 14 by coupling 30 provides a continuous flow of ambient temperature air into retort 12 through plate 22. Liquid pump 32 pumps denatured ethanol through a vertically oriented metallic tube 34 extending axially into tube 14 and particulate bed 26. Valve 36 permits liquid to be drained from tube 34 when generator 10 is not operating. In this embodiment, the air flow is adjusted to about 600 cubic feet per hour (45 pounds per hour). Ethanol is pumped at the rate of 25 pounds per hour. Thus, the air to ethanol weight ratio is about 1.8.

The temperature of the particulate bed 26 is maintained at about 1600° F. by heating elements 16. Since the liquid ethanol is pumped directly into the heated bed 26, it vaporizes before mixing with air. Particulate bed 26 creates turbulent flow of the air and ethanol vapors to aid in mixing the reactants and also helps to heat the reactants to the desired temperature.

Under such conditions, reaction between the ethanol and air occurs very quickly. The initial hot product gas mixture flows up retort 12 and exits through outlet 24 into cooler tube 38. A circulating water jacket 40 surrounds tube 38 and acts to quickly cool the product gas to a temperature of about 80° F. The initial product gas exiting retort 12 through outlet 24 is substantially free of carbon particles or soot. Quick cooling is necessary to prevent undesired secondary reactions from occurring that might otherwise produce soot and increase the carbon dioxide concentration. Drain 42 permits water to be removed that condenses out of the product gas as it cools.

The partially cooled product gas passes through a metallic tube 44 and into a refrigerated chiller 46. Chiller 46 is of the type in which the gas flows past tubes 48 containing gaseous freon. Chiller 46 further cools the product gas to about 40° F. Water that condenses out is removed via a suitable drain 50, so that the dew point of the product gas is effectively lowered to about 40° F.

Approximately 1200 cubic feet per hour of generator product gas exits chiller 46 through tube 52 and passes to a heat treating furnace (not shown). The approximate composition of the generator gas is shown in Table 1. The water concentration of 1% corresponds to a dew point of 44° F.

TABLE 1

| Species | Percent by Volume |
|---|---|
| $H_2$ | 32.3 |
| $N_2$ | 31.6 |
| CO | 14.2 |
| $CH_4$ | 12.9 |
| $CO_2$ | 3.5 |
| $H_2O$ | 1.0 |
| $O_2$ | .1 |

The cooled generator product gas is then introduced into a conventional heat treating furnace to provide a carburizing atmosphere. In this example, the generator gas is used to carburize pump rotors manufactured from steel that is conventionally designated AISI 51L 20. The gas was first diluted with 25% by volume nitrogen. Nitrogen is generally neutral to heat treating operations and the addition was necessary because the particular generator was too small to supply the particular furnaces employed in these tests. Therefore, 400 cubic feet per hour of generator gas was mixed with 100 cubic feet per hour of dried nitrogen to provide 500 cubic feet per hour of furnace atmosphere. The mixture was pumped into a conventional heat treating furnace heated to 1600° F. and containing the pump rotors. After three and a half hours, a 0.030 inch case carburized of desired hardness had developed in the rotors. The case was equivalent in commercial acceptability to that produced using prior art carburizing techniques, but was formed without the use of natural gas.

As mentioned above, the constituents in the generator gas react further after entering the furnace and these reactions have a significant effect on the composition and properties of the furnace atmosphere. The methane concentration is reduced from about 13% in the undiluted generator product gas to 2–4% in the furnace atmosphere, a level suitable for normal carburizing treatments. Because the ethylene also acts as a carburizing agent, a lower methane concentration could be used than was possible in prior art natural gas atmospheres. In this embodiment, the carbon potential of the atmosphere was controlled only by monitoring the methane concentration which remained between 2 and 4% by volume.

The furnace reactions also increase the concentration of carbon monoxide from 14% to about 19%, while decreasing the concentrations of water and carbon dioxide, constituents that interfere with carburizing operations, to acceptable levels. The $CO_2$ level remained between 1 and 2% within the furnace. The dew point drops from 44° F. to about 14° F. The effect of the furnace reactions on other constituents is unknown.

The composition of the generator gas, and thus the furnace atmosphere, can be significantly altered by changing the reaction conditions. For instance, a longer reaction time within the retort permits undesired reactions to occur that produce carbon particles or soot that interfere with normal generator operation and are detrimental to the desired heat treating operations. Longer reaction times also reduce the methane concentration and increase the carbon dioxide concentration, making the resulting gas less carburizing. The reaction time depends primarily on the size of the retort and the time that the hot gas interacts before being cooled. However, for a given generator, the reaction time is more easily controlled by adjusting the flow of reactants into the reaction chamber while maintaining their ratio constant. It is essential to the practice of this invention that the reaction time be sufficiently long to enable substantially all free oxygen to react, but not continue so long as to produce soot in the product gas exiting the retort.

The reaction temperature is another important factor influencing the composition of the generator product gas. Temperatures greater than 1300° F. are necessary to favor the formation of products containing carbon monoxide and hydrogen. At temperatures between 900° F. and 1300° F., the following reaction is favored:

$$2CO \rightarrow CO_2 + C(Soot)$$

Although the hot generator product gas could be introduced directly into the heat treating furnace, quick chilling is preferred to prevent soot formation by the above reaction. That is, the product gas is preferably cooled immediately after exiting the generator to a temperature below 900° F. in order to prevent carbon particles from forming as a result of the carbon monoxide reaction. The maximum reaction temperature is generally limited by the capacity of the equipment to withstand high temperatures.

The most important factor in obtaining an appropriate heat treatment atmosphere is the ratio of the reactants. The relationship between the composition of the gas and the air to ethanol weight ratio is shown graphically in FIG. 2. The data was obtained by operating the generator described in the preferred embodiment with a retort temperature of 1700° F. and a constant air flow rate of 600 cubic feet per hour (about 45 pound per hour). The gas was then introduced into a furnace operated at 1700° F. without the addition of nitrogen or other compounds. The ordinate represents the percent by volume of the various species present in the atmosphere. The lower abscissa indicates the amount of alcohol pumped into the retort in pounds per minute and the upper abscissa the resulting weight ratio of air to alcohol. Complete combustion of ethanol in air requires an air to fuel ratio of about 9. From the ratio appearing in FIG. 2, it can be seen that a substantial excess of ethanol was present in the reactant mixtures.

The graph indicates the composition curves for both the generator gas and the furnace atmosphere for three important species: carbon monoxide, CO; carbon dioxide, $CO_2$; and methane, $CH_4$. In general, for a specific ratio, the carbon monoxide concentration increases in the furnace as compared to the initial product gas and the methane and carbon dioxide concentrations decrease. As appears in FIG. 2, the generator product gas produced by reacting a mixture having an air to ethanol ratio of 1.25 at the aforementioned conditions contains about 20% CO, about 17% $CH_4$ and about 3% $CO_2$ and forms a furnace atmosphere containing about 24% CO, about 3% $CH_4$ and less than about 0.3% $CO_2$. For an air to fuel ratio of about 2.9, the generator product gas contains about 10% CO, about 5% $CH_4$ and about 7% $CO_2$ and forms a furnace atmosphere containing about 21% CO, about 1% $CH_4$ and about 0.5% $CO_2$.

Figure 2:
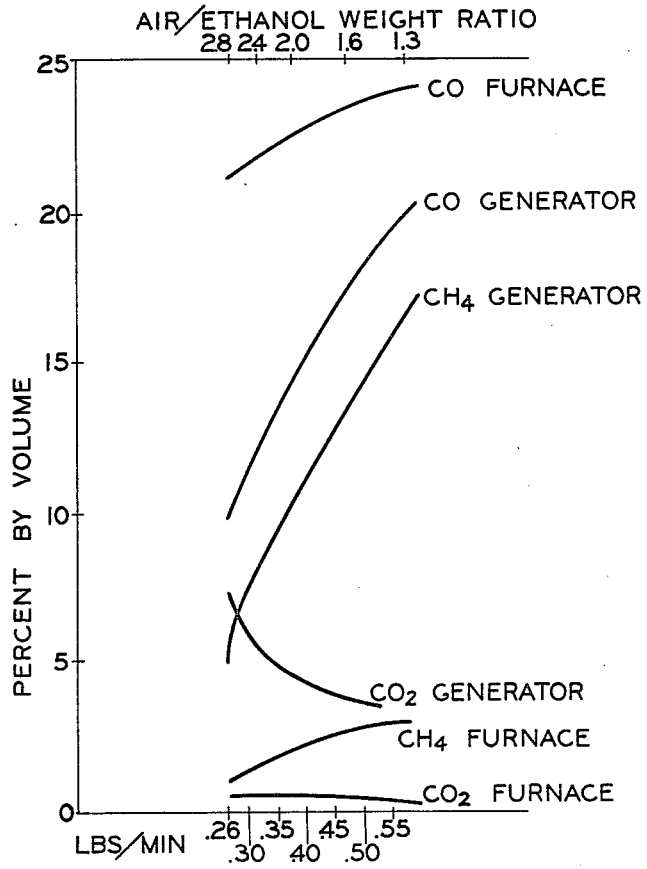
FIG. 2 is a graph showing the relationship between the air-to-ethanol weight ratio and the composition of the generator product gas and the corresponding furnace atmosphere.

It is apparent that a desired heat treatment atmosphere can be easily obtained by adjusting the air to ethanol ratio. Since the carbon potential of the atmosphere is related to the amount of methane present in the furnace atmosphere, decreasing the air to ethanol ratio produces more methane and thereby a more reactive carburizing gas. However, increasing the air to alcohol ratio decreases the amount of methane present in the furnace atmosphere. Thus, an air to ethanol ratio approaching 3 might be more suitable for a noncarbonizing heat treatment operation such as sintering or clean hardening. FIG. 2 shows only a relatively small range of air to fuel ratios, operating outside that range would likely continue the trends as indicated by the curves.

While in the preferred embodiment denatured ethanol was reacted in the generator, methanol and other low molecular weight alcohols could also be suitably employed. Higher molecular weight alcohols (more than 4 carbon atoms) tend to produce tar deposits that interfere with the opration of the retort and accompanying equipment. It is also apparent that, while this invention has been disclosed in terms of a particular retort and cooling assembly, other endothermic-type atmosphere generators are readily commercially available that can be adapted to operate using alcohol. Since the function of the refrigerated atmosphere chiller is to condense more water out of the generator product gas, it is consistent with the practice of this invention to replace the chiller with a suitable desicant.

The reaction bed must provide a surface conducive to the reaction. It is unknown whether alumina-silica particles have a catalytic effect. Particles composed solely of alumina have also been found to be suitable. Nickel oxide, the catalyst typically employed in natural gas fed endothermic-type generators, has also been successfully used in the practice of this invention, but it has been found that several commercially available nickel oxide catalysts contain support materials that degrade when used for an alcohol-air partial oxidation reaction.

The generator gas produced by this invention can be used to provide a soot-free, nonoxidizing atmosphere for a variety of heat treating processes. Although in the preferred embodiment the generator gas was diluted with nitrogen, it is apparent that proper adjustment of reaction parameters can provide an atmosphere composed only of generator gas and having a wide range of carburizing potentials. It is also apparent to one skilled in the art that the generator gas can be mixed with other well known chemicals to provide furnace atmospheres having particular properties. It has been found useful to generate gas having a lower carbon potential and mix it with natural gas or use other prior art methods to produce a carburizing furnace atmosphere.

Although this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A method of producing a gaseous composition suitable for use as an atmosphere in heat treating metals, said composition being produced by a partial oxidation reaction between air and ethanol, said method comprising reacting a gaseous mixture consisting essentially of air and ethanol, the weight ratio of air to ethanol being between 1.0 and 3.0, said mixture being heated at a temperature between 1400° F. and 1850° F. in a bed of particles providing a surface conducive to said reaction, said reaction being for a period of time to form a substantially soot-free gaseous product containing substantially no oxygen and comprising hydrogen, carbon monoxide, carbon dioxide, methane, and water, said product containing at least 5 percent by volume methane and at least 3 percent by volume carbon dioxide, cooling the product gas to a temperature below 100° F. to minimize soot formation, and removing any water that condenses and introducing said product gas into a furnace containing metal to be treated and maintained at a temperature at which metal is suitably heat treated, whereby said product gas undergoes further reaction within said furnace that lowers the methane and carbon dioxide concentrations to produce a nonoxidizing atmosphere suitable for heat treating said metal.

2. A method of producing a gaseous composition for use as an atmosphere for carburizing, said composition being produced by a partial oxidation reaction between air and ethanol, said method comprising reacting a gaseous mixture consisting of air and ethanol, the weight ratio of air to ethanol being less than about 2, said mixture being heated at a temperature between 1400° F. and 1850° F. in a bed of particles providing a surface conducive to the reaction, said reaction being for a period of time to form a substantially soot-free gaseous product containing substantially no oxygen and comprising hydrogen, nitrogen, carbon monoxide, carbon dioxide, methane, and water, said product containing at least 5 percent by volume methane and at least 3 percent by volume of carbon dioxide, cooling the product gas to a temperature of about 40° F. or lower to minimize soot formation and removing any water that condenses out, and introducing said product gas into a furnace containing metal to be treated and maintained at a temperature at which metal is suitably heat treated, whereby said gaseous product undergoes further reaction within said furnace that lowers the methane and carbon dioxide concentrations to produce an atmosphere suitable for carburizing said metal.

3. The method of producing a gaseous composition by a partial oxidation reaction between air and ethanol, said composition being suitable for use as an atmosphere in heat treating metals, said method comprising the steps of reacting a mixture consisting of air and ethanol in a proportion of ethanol-to-air greater than that which is stoichiometrically capable of complete combustion, the reaction being carried out at a temperature greater than 1300° F. in an externally heated bed of particles providing a surface conducive to the reaction and for a period of time sufficient to form a product gas comprising predominately unreacted nitrogen, hydrogen and carbon monoxide and containing at least 5 percent by volume methane, at least 3 percent by volume carbon dioxide, and water; but containing substantially no oxygen and substantially no soot, and introducing the product gas into a furnace containing metal for treatment and maintained at a suitable temperature therefor, said product gas undergoing further reaction within said furnace that lowers the methane and carbon dioxide to suitable heat treatment level and thereby providing a nonoxidizing atmosphere conducive to said heat treatment.

4. The method of producing a gaseous composition by a partial oxidation reaction between air and ethanol, said composition being suitable for use as an atmosphere in heat treating metals, said method comprising the steps of reacting a mixture consisting of air and ethanol in a proportion of ethanol-to-air greater than that which is stoichiometrically capable of complete combustion, the reaction being carried out at a temperature greater than 1400° F. but less than 1850° F. in an externally heated bed of particles providing a surface conducive to the reaction and for a period of time sufficient to form a product gas comprising predominately unreacted nitrogen, hydrogen and carbon monoxide, and containing at least 5 percent by volume methane, at least 3 percent by volume carbon dioxide, and water; but containing substantially no oxygen and substantially no soot, cooling the product gas to minimize soot formation and removing water as necessary to reduce the dew point of the product gas to below 100° F. and introducing the cooled product gas into a furnace containing metal for treatment and maintained at a suitable temperature therefor, said product gas undergoing further reaction within said furnace that lowers the methane and carbon dioxide to suitable heat treatment level and thereby providing a nonoxidizing atmosphere conducive to said heat treatment.

* * * * *

UNITED STATES PATENT AND TRADEMARK OFFICE

CERTIFICATE OF CORRECTION

PATENT NO. : 4,236,941

DATED : December 2, 1980

INVENTOR(S) : Ray F. Main, Jr.

It is certified that error appears in the above-identified patent and that said Letters Patent are hereby corrected as shown below:

Column 9, line 27, "volume of carbon dioxide" should read -- volume carbon dioxide --.

Signed and Sealed this

*Thirty-first* Day of *March 1981*

[SEAL]

*Attest:*

RENE D. TEGTMEYER

*Attesting Officer*

*Acting Commissioner of Patents and Trademarks*